United States Patent [19]

Tupper

[11] Patent Number: 4,462,316

[45] Date of Patent: Jul. 31, 1984

[54] LOAD TRANSFER OR TRAVERSING DEVICE

[76] Inventor: Alan W. Tupper, The Weavers House, Castle Combe, Wiltshire, SN14 7HX, England

[21] Appl. No.: 360,986

[22] Filed: Mar. 23, 1982

[30] Foreign Application Priority Data

Apr. 16, 1981 [GB] United Kingdom ..... 8112221

[51] Int. Cl.[3] ..... B61B 7/00

[52] U.S. Cl. ..... 105/151; 104/93; 104/182; 105/148

[58] Field of Search ..... 104/89, 93, 106, 112, 104/182, 185, 186, 198, 199; 105/148, 150, 151, 154, 155; 191/76; 16/107

[56] References Cited

U.S. PATENT DOCUMENTS 506,037 10/1893 Forbes ..... 104/182
807,141 12/1905 Tatum ..... 16/107 X
4,265,179 5/1981 Tupper et al. ..... 104/182

FOREIGN PATENT DOCUMENTS 1064850 10/1979 Canada ..... 105/154
184237 4/1907 Fed. Rep. of Germany ..... 191/76

*Primary Examiner*—Randolph Reese
*Attorney, Agent, or Firm*—Scully, Scott, Murphy & Presser

[57] ABSTRACT

A load-transfer device comprising at least one rotatable wheel having a series of equally spaced peripheral recesses, a guide element mounted at a peripheral part of the wheel, and a load connection element for attachment of a load to the device. The wheel and guide member have cooperating portions allowing rotation of the wheel about its axis relative to the guide member to allow transversely extending support elements, which the device encounters in use, to pass through the device in one of said recesses as the wheel rotates relative to the guide member. In order to enable the device to withstand relatively heavy loading, interengaging plug and socket portions are provided between the connection element and an adjacent face of the wheel.

15 Claims, 9 Drawing Figures

LOAD TRANSFER OR TRAVERSING DEVICE

FIELD AND BACKGROUND OF THE INVENTION

This invention relates to a device for enabling a load to be moved along a path defined by a guide member or a series of guide members, freely past support are attachment points for the guide member or members. Such a device is described in my British Patent Specification No. 1582201 and corresponding U.S. Pat. No. 4,265,179 and the present invention provides improvements in the devices disclosed in that specification, particularly with a view to providing constructions which enable the device to withstand heavier loadings.

SUMMARY OF THE INVENTION

According to the invention there is provided a load-transfer device comprising at least one rotary wheel which is formed with several recesses in its periphery, the recesses being evenly spaced around the wheel with adjacent recesses being separated by a projecting part of the wheel; a guide member supported on the wheel, said guide member and said wheel having cooperating relatively rotatable surfaces and the arrangement being such that, when the device and a load bearing element, which extends transversely to the plane of said one wheel and cooperates in use with the device, encounter one another, said one wheel can rotate about its axis relative to the guide member with said element being received, guided and passed in one or a succession of the aforesaid recesses with said element, or an elongate member supported thereby, being located with respect to the wheel by the guide member; and a connection element for attachment of a load or a load support to the device, the connection element being pivotally mounted on wheel about the axis thereof and there being provided interengaging plug and socket portions between the connection element and an adjacent face of said wheel.

In some constructions according to the invention, a single wheel, which may be formed in one or more parts, is provided with the guide member having portions straddling the periphery of the wheel. In such constructions, the elongate member may be located in use in circumferentially extending recesses provided in the tips of the projecting parts of the wheel.

In other constructions according to the invention a pair of spaced wheels as aforesaid may be provided with at least a part of the guide member located in the space between the wheels.

In further constructions according to the invention three or more spaced wheels may be provided with a guide member located between each adjacent pair of such wheels to locate a respective elongate element which extends in use between each such pair of wheels.

The connection element may be in the form of a yoke-member, the arms of which embrace the, or a respective, wheel and are pivotally mounted on the axis of the wheel. Each such arm may have a trunnion member on one or both sides thereof which is received in a corresponding recess in a central area of the, or a respective, juxtaposed surface of an adjacent wheel. The trunnion member may be annular in order to encircle axle means on which the wheel(s) are mounted.

In constructions according to the invention, the guide member and said at least one wheel may have interengaging male and female connecting portions. Preferably such portions comprise an arcuate flange on the guide member which engages in corresponding grooves formed in the, or a respective, wheel to permit rotation of the wheel(s) about its axis relative to the guide member. In some constructions according to the invention a guide member may be located in a space between a pair of wheels, wherein both wheels have projecting parts as aforesaid defining said recesses and the guide member has two arcuate flange means engaging in respective cooperating grooves formed in the adjacent surfaces of both wheels thereby to retain the guide member in the space between the wheel whilst allowing rotation of the wheels relative to the guide member. Said plug and socket portions may comprise annular projections on the connecting element, which encircle axle means on which the wheels are rotatably mounted and engage in corresponding recesses in said wheels.

In constructions according to the invention where grooves are formed in the projecting parts of the wheel(s), the wheel(s) may have an end surface(s) which is generally dome-shaped, e.g. hemispherical or a similar shape and with an integrated central area which provides a bulk of material in order to provide an adequate amount of material at the location of the grooves to accommodate loads imposed thereon during use which could otherwise cause fracture at such locations. In other such constructions, an additional amount of material, e.g. in the form of arcuate beads of material around the opposite face of the wheel from that in which the grooves are formed and in axial alignment with the grooves respectively, may be provided for the same purpose.

In devices according to the invention for enabling a load to be moved along an elongate member defining a guide path or track, the aforesaid recesses in said at least one wheel of the device may have a width not substantially greater than the transverse dimension of the elongate member to resist engagement of the elongate member in such recesses under twisting loads thereon in a direction across the plane containing the recessed wheel and consequential detachment of the elongate member from the device during further rotation of the wheel relative to the guide member. The guide member may be sized and shaped to have a surface in sliding contact with the elongate member to locate such member at a position (when viewed in the axial direction of the recessed wheel) sufficiently towards the base of any recess (when the recess is perpendicular to the longitudinal extent of the elongate member) whereby the wheel will be prevented from rotating to allow complete disengagement from the device on engagement of the elongate member in any recess during rotation of the recessed wheel as a result of twisting loads on the elongate member as aforesaid. Other means for preventing such disengagement of the elongate member may comprise annular members located in arcuate grooves in the projecting parts of the wheels, particularly when such wheels are dome-shaped, or a disc member located adjacent an end face of a respective wheel to extend part way along said recesses provided in the periphery of the wheel.

DETAILED DESCRIPTION

Figure 1:
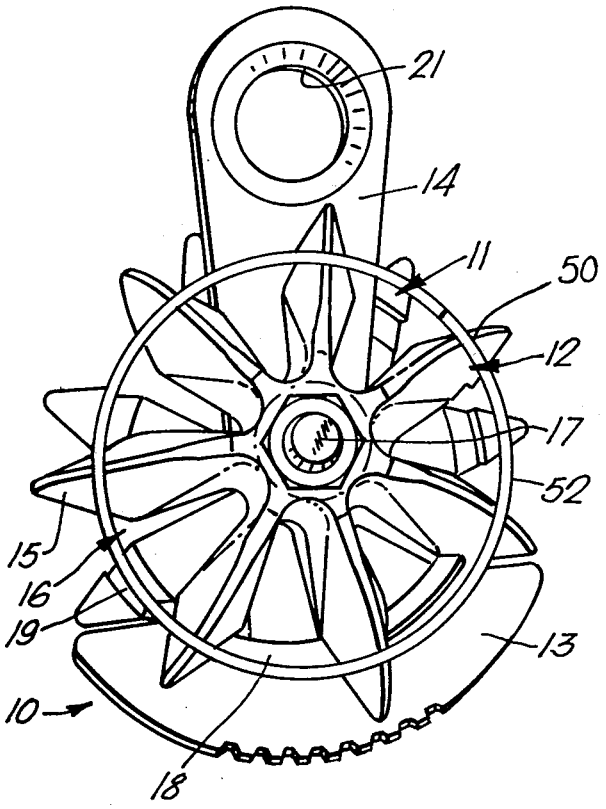
FIG. 1 is a perspective view of a traversing device embodying the invention.
Figure 3:
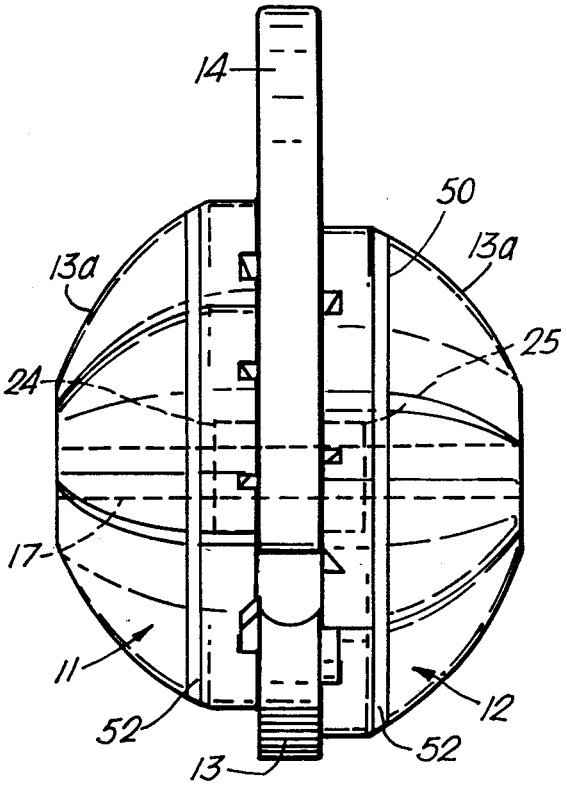
FIG. 3 is a side view of the device of FIG. 1.

FIG. 1 shows a traversing device 10 in accordance with the invention, which comprises two wheel members 11,12, a guide member 13 and a load connector member 14. As seen in FIG. 3, each wheel 11,12 has a generally dome-shaped outer surface with confronting flat surfaces. The dome-shaped surfaces 13*a* comprise a relatively flat central area joined by a curved section to an annular axially extending outer rim portion. Referring again to FIG. 1, each wheel, in this particular embodiment, has seven radially projecting portions 15 which define therebetween seven equi-angularly spaced recesses 16. The wheels are rotatably mounted on an axle 17 in a spaced apart relationship as seen in FIG. 3.

The guide member 13, positioned between the wheels at a peripheral part thereof, has a pair of axially projecting arcuate flanges 18 which engage in correspondingly shaped grooves 19 formed in the inner confronting surfaces of the projecting parts 15 of the wheels to locate the guide member 13 in position between the wheels while allowing the wheels to rotate complete revolutions in either direction with respect to the guide member.

Figure 4:
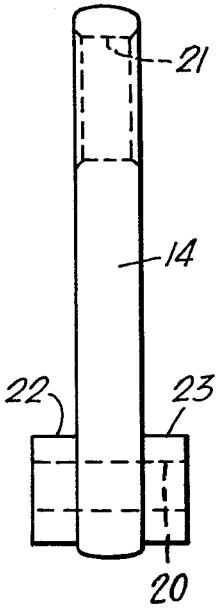
FIG. 4 is a side view of the load connecting member of the devices of FIGS. 1 to 3.

As shown in FIG. 4, the load-connecting element, which is in the form of a strip rounded at both ends and narrowing in width towards its lower end (as seen in FIGS. 1), has an aperture 20 at its lower end which is sized to provide a pivotal mount on the axle 17 and has an eyelet 21 at its upper end for connecting a load thereto. The connector member 14 also has a pair of projecting bosses 22,23 around and providing an extension of the aperture 20. These bosses engage in recesses 24 and 25 (see FIG. 3) respectively, which are provided in the confronting surfaces of the wheels 11 and 12.

In this way shearing loads applied to the axle 17 in use are spread over a greater area of such axle by providing the plug and socket type engagement of the bosses 22 and 23 of the connector member 14 in the recesses 24 and 25 of the wheel members 11 and 12. Furthermore by adopting the dome-shaped wheel members sufficient material is conveniently provided to accommodate forces applied to the wheel members under load conditions and, in particular, to reduce the likelihood of fracture of the projecting parts 15 at the location of the grooves 19 therein.

In the embodiment shown in FIGS. 1 and 3, further arcuate grooves 50 are provided in the outer surfaces of the projecting parts 15 of the wheels and resilient retaining rings 52 are snap fitted into these grooves. The retaining rings act to prevent a flexible elongate member, e.g. a wire or rope, from engaging, under twisting loads on the elongate member, in the recesses 16 in the wheels sufficiently to allow the elongate member to be disengaged or "wound out" of the device 10 on subsequent rotation of the wheels relative to the guide member 13.

Thus, as shown in the drawings and described above, the retaining rings 52 hinder engagement of the elongate member in the recess 16 in the wheels if the elongat member is twisted under lateral loading imposed thereon. This prevents the likelihood of the elongate member from becoming engaged in the recesses 16 and then being wound out of the device from its usual position beneath the guide member 13, on subsequent rotation of the wheel 11 or 12 and thereby becoming completely detached from the device 10.

In use the traversing device 10 is engaged with an elongate guide member, for example a wire or cable or a rigid rod or tube, which is supported by intermediate transversely extending supporting members along a required path of movement. The elongate guide member extends between the wheel members 11 and 12 and in sliding contact with the guide member 13 which slides along the elongate member when a load (e.g. a lanyard hooked into eyelet 21 of connector member 14 and attached to a life jacket of a person on board a boat) is attached thereto. When the device encounters the aforesaid transverse support member(s) of the elongate guide member, such member is received in a recess 16 in one or both wheel members, which rotate with respect to the guide member 13 to allow the transverse support member to pass through the device while the elongate guide member is securely engaged in the traversing device 10 by the guide member 13.

Figure 2:
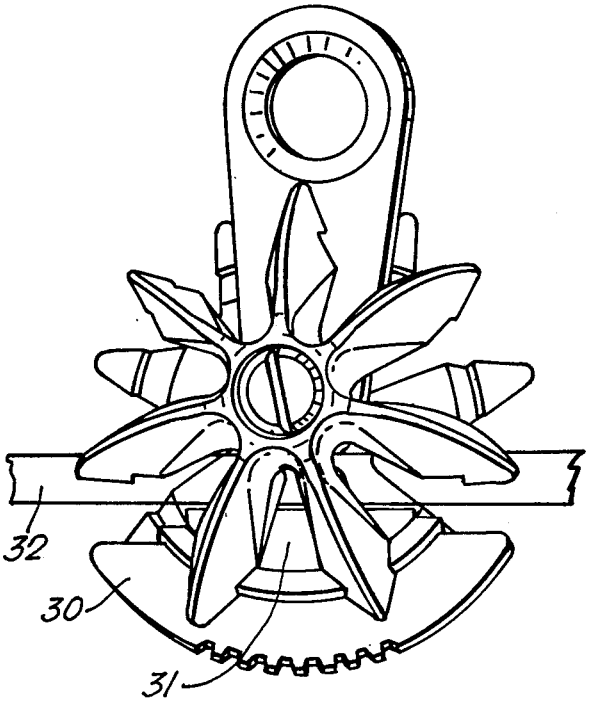
FIG. 2 is a perspective view of a second embodiment.

The traversing device shown in FIG. 2 is similar to that shown in FIG. 1 with the exception that a modified guide member 30 is provided with an additional skirt portion 31 for sliding contact with elongate member 32 in order to position the elongate member sufficiently deep with respect to the recesses in the wheels so that if the elongate engages in any such recesses under twisting loads, the wheel will be prevented from rotating to allow complete disengagement of the elongate member 32 from the device. In this way detachment by "winding-out" of the elongate member when it is twisted to engage in a recess in the wheel, is prevented. A further design feature which can achieve this purpose is to design the recesses so that the transverse dimension thereof is not substantially greater than the transverse dimension of the elongate member 32 to resist engagement of the elongate member in such recesses under twisting loads.

Figure 5:
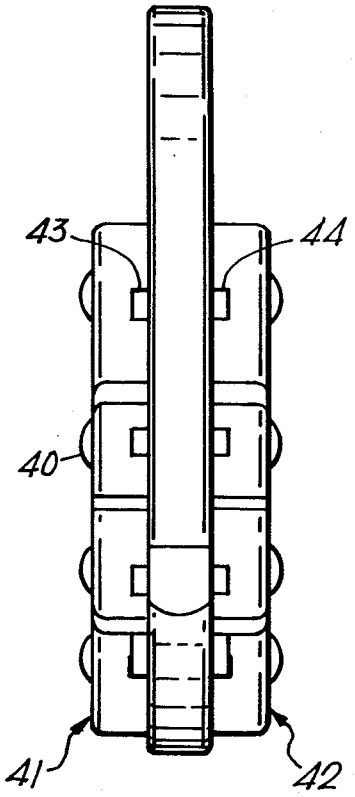
FIG. 5 is a diagrammatic side view of a third embodiment.

FIG. 5 shows a further embodiment in which the dome-shaped members are replaced by substantially planar members. These members are reinforced by the provision of integral circumferential extending bead portions 40 on the outer surfaces of the projecting parts of the wheel 41 and 42 in axial alignment of the grooves 43, 44 provided therein. These bead portions 40 provided additional strength to counteract any tendency of the wheel members to fracture at the grooves 43, 44.

Figure 6:
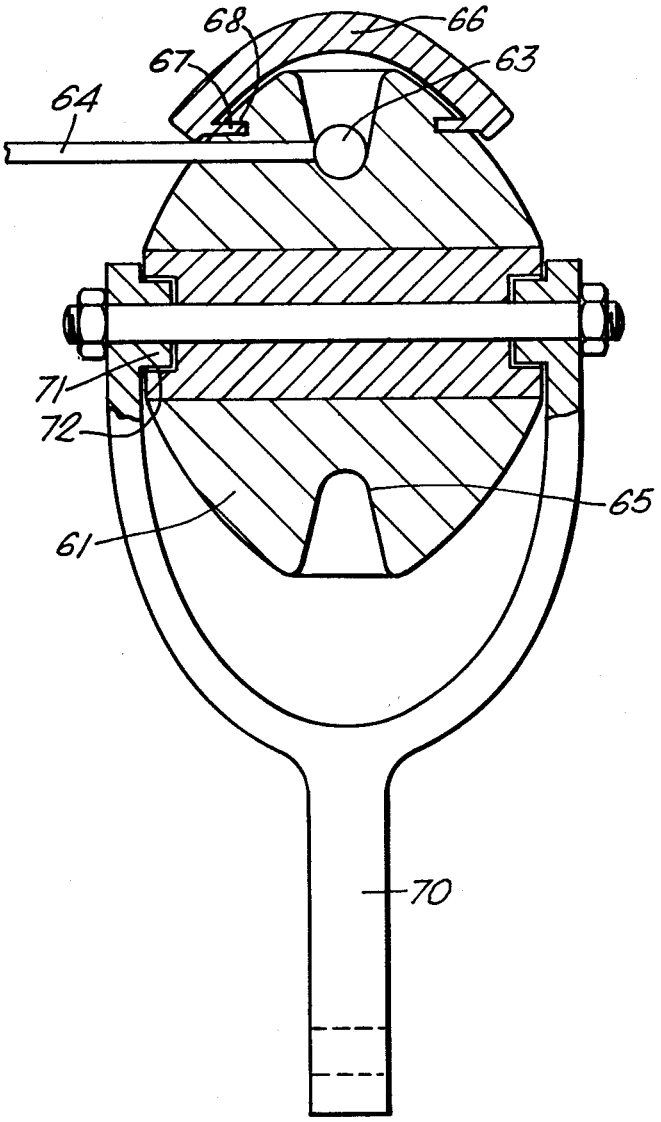
FIG. 6 is a diagrammatic vertical cross-section through a fourth embodiment.

FIG. 6 shows a further embodiment of a traversing device 60 in accordance with the invention. This device has a single wheel 61 which is generally cylindrical in shape and has a seven equiangularly spaced radial recesses in its periphery to receive transverse support members 64 of an elongate member 63 engaged with the device. This wheel could also be provided by a pair of dome-shaped wheels in contact with one another and rigidly connected together. The member 63 is received in circumferentally extending recesses 65 provided in the tips of the projecting parts of the wheel and is retained therein by a guide member 66 which spans a peripheral part of the wheel and has a pair of arcuate flanges 67 which engage in corresponding arcuate grooves 68 in opposide sides of the wheel to retain the guide member thereon while allowing rotation of the wheel with respect to the guide member.

A load connection member 70 has a pair of arms which embrace the wheel and have a pair of trunnion members 71 which engage in cylindrical recesses 72 in the wheel to allow rotation of the wheel about its axis in order to allow a transverse member 64 to pass through the device in a radial recess on the wheel, which rotates about its axis relative to the guide member 62.

Figure 7:
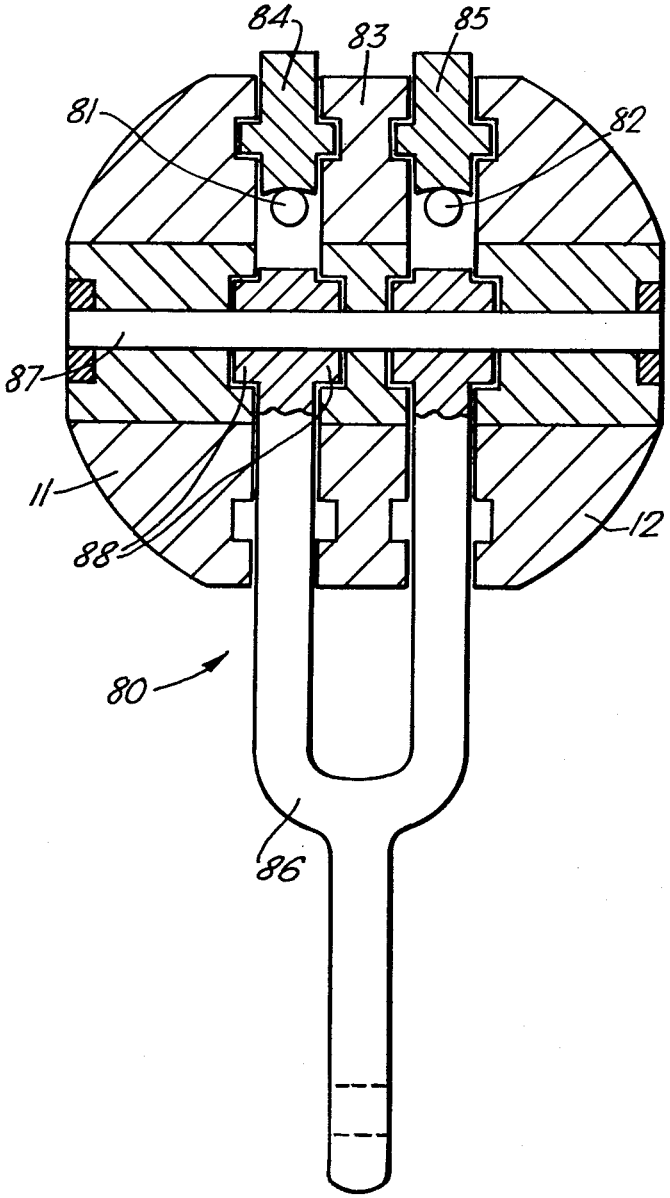
FIG. 7 is a diagrammatic vertical cross-section through a fifth embodiment.

The embodiment of FIG. 7 provides a device 80 which is engagable with a pair of parallel elongate members 81, 82. The device is similar to that shown in FIGS. 1 or 2, but a third recessed wheel 83 is located between and in spaced relation to the dome-shaped wheels 11, 12. Two guide members 84, 85 are provided between a respective wheel 11, 12 and the central wheel 83. The load connection member is in the form of a clevis 86, each arm of which is provided pivotally mounted on the axle 87 of the wheels and has bosses 88 projecting on each side thereof to engage in corresponding recesses in the adjacent wheels.

Figure 8:
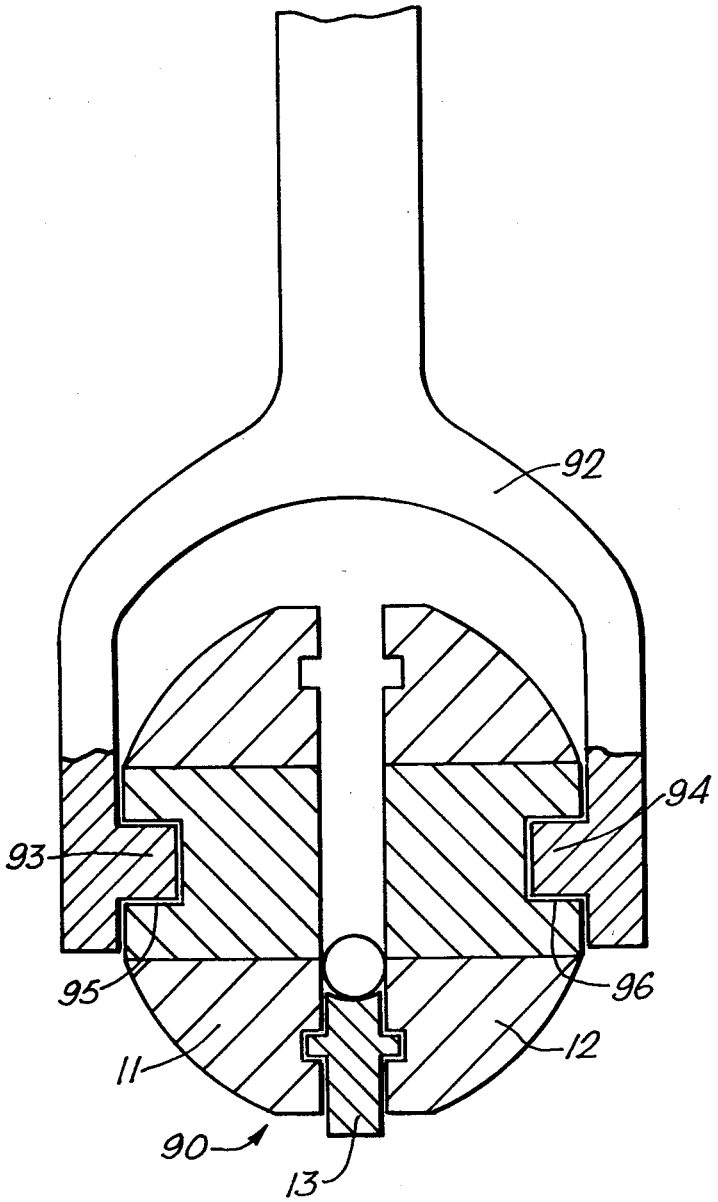
FIG. 8 is a diagrammatic vertical cross-section through a sixth embodiment.

FIG. 8 shows an embodiment of a traversing device for accommodating an elongate member having a relatively large transverse dimension, and can readily accommodate elongate members of various different transverse dimensions. The device 90 comprises two dome-shaped wheels 11, 12 having a guide member 13 therebetween similar to the embodiments of FIGS. 1 to 3. However, in this embodiment the load connection 91, which also provides the rotary mount for the wheels, is in the form of a yoke 92 having a pair of trunnions 93, 94 on the inner surfaces of its arms. The trunnions engage in corresponding recesses 95, 96 formed centrally in the outer surfaces, of the wheels. Therefore the space between the wheels is left relatively unobstructed to receive larger diameter ropes, etc.

Figure 9:
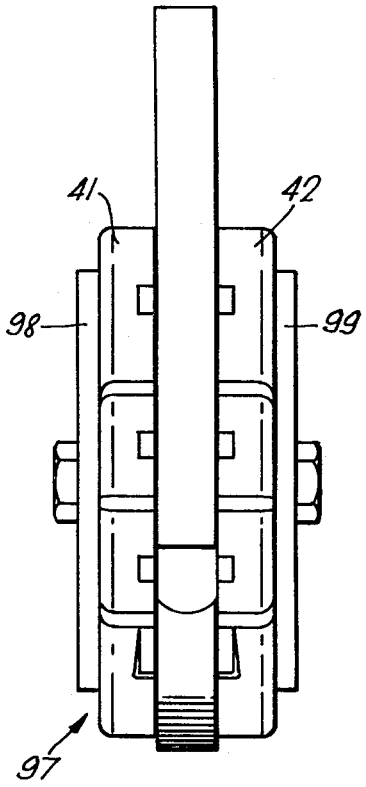
FIG. 9 is a diagrammatic vertical cross-section through a seventh embodiment.

FIG. 9 shows a further traverse device 97 similar to that of FIG. 5 in which disc members 98, 99 are located against the outer surfaces of the wheels 41, 42. The outer diameter of the members 98,99 is less than that of the projecting parts of the wheels to allow transverse members supporting the elongate member to engage therein, but is sufficient to assist in preventing a flexible elongate member from engaging in a recess in the wheel under a twisting load and then to be "wound" past the guide member thereby disengaging the elongate member from the traversing device. These discs therefore act in a similar fashion to the retaining rings 52 of the embodiment of FIGS. 1 and 3.

The components of the above described traversing devices may be made of any suitable material, for example, a metal, such as stainless steel, or for lighter uses a plastics material may be used.

I claim:

1. A load-transfer device comprising a pair of spaced rotary wheels which are each formed with several recesses in its periphery, the recesses being evenly spaced around the respective wheel with adjacent recesses being separated by a projecting part of the wheel; a guide member supported on the wheels and having at least a part extending in the space between the wheels, said guide member and said wheels having cooperating relatively rotatable surfaces and the arrangement being such that, when the device and a load bearing element, which extends transversely to the plane of said wheels and cooperates in use, with the device, encounter one another, said wheels can rotate about its axis relative to the guide member with said element being received, guided and passed in one or a succession of the aforesaid recesses with said element, or an elongate member supported thereby, being located with respect to the wheels by the guide member; a connection element for attachment of a load or a load support to the device, the connection element being pivotally mounted on said wheels about the axis thereof; and grooves formed in said projecting parts on a first side of each wheel; wherein beads of material are formed on said projecting parts on the side of the said wheels opposite to the said one side thereof and in axial alignment with the grooves respectively.

2. A load-transfer device comprising a pair of spaced rotary wheels which are each formed with several recesses in its periphery, the recesses being evenly spaced around the respective wheel with adjacent recesses being separated by a projecting part of the wheel; a guide member supported on the wheels and having at least a part extending in the space between the wheels, said guide member and said wheels having cooperating relatively rotatable surfaces and the arrangement being such that, when the device and a load bearing element, which extends transversely to the plane of said wheels and cooperates in use with the device, encounter one another, said wheels can rotate about its axis relative to the guide member with said element being received, guided and passed in one or a succession of the aforesaid recesses with said element, or an elongate member supported thereby, being located with respect to the wheels by the guide member; a connection element for attachment of a load or a load support to the device, the connection element being pivotally mounted on said wheels about the axis thereof; interengaging plug and socket portions are provided between the connection element and adjacent faces of said wheels; and grooves formed in said projecting parts on a first side of each wheel, wherein beads of material are formed on said projecting parts on the side of the said wheels opposite to said one side thereof and in axial alignment with the grooves respectively.

3. A device according to claim 2 wherein the guide member and said wheels have interengaging male and female connecting portions.

4. A device according to claim 3 wherein said interengaging portions comprise arcuate flanges on the guide member which engage in corresponding grooves formed in adjacent surfaces of the projecting parts of said wheels to permit rotation of the wheels about their axes relative to the guide member.

5. A device according to claim 2 wherein said plug and socket portions comprise annular projections on the connecting element, which projections encircle axle means on which the wheels are rotatably mounted and engage in corresponding recesses in said wheels.

6. A load-transfer device comprising at least one rotary wheel which is formed with several recesses in its periphery, the recesses being evenly spaced around the wheel with adjacent recesses being separated by a projecting part of the wheel; a guide member supported on the wheel, said guide member and said wheel having cooperating relatively rotatable surfaces and the arrangement being such that, when the device and a load bearing element, which extends transversely to the plane of said one wheel and cooperates in use with the device, encounter one another, said one wheel can rotate about its axis relative to the guide member with said element being received, guided and passed in one or a succession of the aforesaid recesses with said element, or an elongate member supported thereby, being located with respect to the wheel by the guide member; a connection element for attachment of a load or a load support to the device, the connection element being pivotally mounted on said wheel about the axis thereof; and annular members located in arcuate grooves in end surfaces of the projecting parts of the wheels to resist disengagement from the device of an elongate member which cooperates in use with the device.

7. A load-transfer device comprising at least one rotary wheel which is formed with several recesses in its periphery, the recesses being evenly spaced around the wheel with adjacent recesses being separated by a projecting part of the wheel; a guide member supported on the wheel, said guide member and said wheel having cooperating relatively rotatable surfaces and the arrangement being such that, when the device and a load bearing element, which extends transversely to the plane of said one wheel and cooperates in use with the device, encounter one another, said one wheel can rotate about its axis relative to the guide member with said element being received, guided and passed in one or a succession of the aforesaid recesses with said element, or an elongate member supported thereby, being located with respect to the wheel by the guide member; a connection element for attachment of a load or a load support to the device, the connection element being pivotally mounted on said wheel about the axis thereof; interengaging plug and socket portions are provided between the connection element and and adjacent face of said wheel; and annular members located in arcuate grooves in end surfaces of the projecting parts of the wheels to resist disengagement from the device of an elongate member which cooperates in use with the device.

8. A device according to claim 7 having a pair of spaced wheels as aforesaid wherein at least a part of the guide member is located in the space between the wheels.

9. A device according to claim 8 wherein said interengaging portions comprise an arcuate flange on the guide member which engages in corresponding grooves formed in adjacent surfaces of the projecting parts of at least one wheel to permit rotation of each wheel about its axis relative to the guide member.

10. A device according to claim 7 wherein the guide member and said at least one wheel have interengaging male and female connecting portions.

11. A device according to claim 7 wherein said plug and socket portions comprise annular projections on the connecting element, which projections encircle axle means on which each wheel is rotatably mounted and engage in corresponding recesses in said wheels.

12. A device according to claim 7 in which grooves are formed in the projecting parts of each, wherein each wheel has at least one end surface which is generally dome-shaped.

13. A load-transfer device comprising a pair of spaced rotary wheels which are each formed with several recesses in its periphery, the recesses being evenly spaced around the respective wheel with adjacent recesses being separated by a projecting part of the wheel; a guide member supported on the wheels and having at least a part extending in the space between the wheels, said guide member and said wheels having cooperating relatively rotatable surfaces and the arrangement being such that, when the device and a load bearing element, which extends transversely to the plane of said wheels and cooperates in use with the device, encounter and another, said wheels can rotate about its axis relative to the guide member with said element being received, guided and passed in one or a succession of the aforesaid recesses with said element, or an elongate member supported thereby, being located with respect to the wheel by the guide member; a connection element for attachment of a load or a load support to the device, the connection element being pivotally mounted on said wheels about the axis thereof; and a disc member is located against an end face of each wheel remote from the other wheel to extend part way along said recesses provided in the periphery of the wheel.

14. A load-transfer device comprising a pair of spaced rotary wheels which are each formed with several recesses in its periphery, the recesses being evenly spaced around the respective wheel with adjacent recesses being separated by a projecting part of the wheel; a guide member supported on the wheels and having at least a part extending in the space between the wheels, said guide member and said wheels having cooperating relatively rotatable surfaces and the arrangement being such that, when the device and a load bearing element, which extends transversely to the plane of said wheels and cooperates in use with the device, encounter one another, said wheels can rotate about its axis relative to the guide member with said element being received, guided and passed in one or a succession of the aforesaid recesses with said element, or an elongate member supported thereby, being located with respect to the wheel by the guide member; a connection element for attachment of a load or a load support to the device, the connection element being pivotally mounted on said wheels about the axis thereof; interengaging plug and socket portions are provided between the connection element and adjacent faces of said wheels, and a disc member is located against an end face of each wheel remote from the other wheel to extend part way along said recesses provided in the periphery of the wheel.

15. A device according to claim 14 including arcuate flanges on the guide member which engage in corresponding grooves formed in adjacent surfaces of the projecting parts of said wheels to permit rotation of the wheels about their axes relative to the guide member.

* * * * *